US010609952B2

(12) United States Patent
Fallon et al.

(10) Patent No.: US 10,609,952 B2
(45) Date of Patent: Apr. 7, 2020

(54) TOBACCO INDUSTRY ROD ASSEMBLY APPARATUS

(71) Applicant: British American Tobacco (Investments) Limited, London (GB)

(72) Inventors: Gary Fallon, London (GB); Martin Paul Fuller, Warwickshire (GB); Thomas Bailey, Warwickshire (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 627 days.

(21) Appl. No.: 15/305,698

(22) PCT Filed: Apr. 14, 2015

(86) PCT No.: PCT/GB2015/051120
§ 371 (c)(1),
(2) Date: Oct. 21, 2016

(87) PCT Pub. No.: WO2015/166209
PCT Pub. Date: Nov. 5, 2015

(65) Prior Publication Data

US 2017/0035099 A1 Feb. 9, 2017

(30) Foreign Application Priority Data

Apr. 30, 2014 (GB) ..... 1407582.4

(51) Int. Cl.
*A24C 5/32* (2006.01)
*A24C 5/47* (2006.01)
*A24D 3/02* (2006.01)

(52) U.S. Cl.
CPC ..... *A24C 5/327* (2013.01); *A24C 5/47* (2013.01); *A24D 3/0229* (2013.01)

(58) Field of Classification Search
CPC ..... A24C 5/327; A24C 5/47; A24D 3/0229
See application file for complete search history.

(56) References Cited

FOREIGN PATENT DOCUMENTS

| | | | |
|---|---|---|---|
| EP | 0599162 | A1 | 6/1994 |
| EP | 0620983 | A1 | 10/1994 |
| EP | 15161386 | A1 | 8/2005 |
| FR | 2516901 | A1 | 11/1982 |
| WO | 2012164067 | A2 | 12/2012 |

OTHER PUBLICATIONS

International Search Report for corresponding International Application PCT/GB2015/051120 filed Apr. 14, 2015; dated Jul. 30, 2015.
Written Opinion of the International Search Authority for corresponding International Application PCT/GB2015/051120 filed Apr. 14, 2015; dated Jul. 30, 2015.

*Primary Examiner* — Michael H. Wilson
*Assistant Examiner* — Dionne W. Mayes
(74) *Attorney, Agent, or Firm* — Cantor Colburn LLP

(57) ABSTRACT

A tobacco industry rod assembly apparatus comprising a tobacco industry rod article infeed (2) having an epicyclic drum arrangement (3) is disclosed. The tobacco industry rod article infeed (2) is configured to transfer tobacco industry rod articles towards an assembly stage.

13 Claims, 4 Drawing Sheets

TOBACCO INDUSTRY ROD ASSEMBLY APPARATUS

FIELD OF THE INVENTION

This invention relates to a tobacco industry rod assembly apparatus, for example a smoking article rod assembly apparatus and a filter rod assembling apparatus. The invention also relates to a method of operating such a tobacco industry rod assembly apparatus so as to make smoking articles or filter rods.

BACKGROUND

It is known to provide machines for assembling smoking articles such as cigarettes. These machines typically comprise a series of drums configured to transfer and/or assemble a filter rod with a tobacco rod so as to form a smoking article. Certain drums are configured so that particular operations are carried out as the rod articles are conveyed by the drum. Once the smoking articles have been assembled, they are transferred to a packaging stage where they are grouped together and enclosed in a packet.

SUMMARY

According to the present invention there is provided a tobacco industry rod assembly apparatus comprising a tobacco industry rod article infeed having an epicyclic drum arrangement, the tobacco industry rod article infeed being configured to transfer tobacco industry rod articles towards an assembly stage.

The term "tobacco industry rod article" used herein is to be understood as a rod article such as a filter rod article, tobacco rod article, or other rod-like article suitable for inclusion in a smoking article.

The term "smoking article" is to be understood as smokable products such as cigarettes, cigars and cigarillos whether based on tobacco, tobacco derivatives, expanded tobacco, reconstituted tobacco or tobacco substitutes and also heat-not-burn products. The smoking article may comprise a tobacco rod component and a filter rod component. The filter rod component may be referred to as a "1-up" filter rod, to distinguish it from longer filter rods used in smoking article assembly (such as "2-up" filter rods which are twice as long as "1-up" filter rods, and "4-up" filter rods which are four times as long as "1-up" filter rods).

In various embodiments, the tobacco industry rod article infeed is configured to transfer filter rod articles towards the assembly stage. The filter rod articles transferred by the tobacco industry rod article infeed may for example each comprise a 4-up rod, a 2-up rod, a 1-up rod, or a filter rod segment for use in forming a multi-segment filter rod.

In one embodiment, the epicyclic drum arrangement may comprise planetary drums rotatable about their own axis, the planetary drums being on a rotational annular carrier, and a sun drum disposed within the annular carrier, wherein the annular carrier and the sun drum rotate about a common axis.

The sun drum comprises segments may be movable relative to one another in a direction parallel to the common axis. This may be so as to enable tobacco industry rod articles to be received, transferred and released by the sun drum. Additionally or alternatively, it may be so as to enable a transfer drum to overlap with the carrier such that the transfer drum engages the sun drum.

In one embodiment, the sun drum rotates at a higher speed than the annular carrier.

In another embodiment, the planetary drums have a tangential speed that equals a tangential speed of the sun drum.

In another embodiment, the sun drum may comprise an outer circumferential surface formed with grooves for receiving tobacco industry rod articles. The grooves may be evenly spaced apart from one another in a direction about the common axis, or they may be grouped together in group(s).

The tobacco industry rod assembly apparatus may further comprise a transfer drum transferring tobacco industry rod articles from the tobacco industry rod article infeed towards the assembly stage.

In an embodiment, the tobacco industry rod assembly apparatus is a smoking article assembly apparatus. In such an embodiment, the tobacco industry rod article infeed comprises a filter rod infeed to transfer filter rod articles towards the assembly stage and the assembly stage comprises an assembly station configured to form smoking articles using said filter rod articles.

The smoking article assembly apparatus may comprise a plurality of modules, and wherein one of said modules comprises the filter rod infeed.

In another embodiment, the tobacco rod industry assembly apparatus is an apparatus for combining filter rod segments to form a multi-segment filter rod. In particular, the rod industry assembly apparatus may be a filter rod assembling apparatus, wherein the assembly stage comprises an assembly station configured to combine a filter segment with another filter segment so as to form a filter rod having a plurality of segments.

According to another aspect of the invention there is provided, a method of operating a tobacco industry rod assembly apparatus comprising transferring tobacco industry rod articles towards a rod assembly stage using a tobacco industry rod article infeed having an epicyclic drum arrangement.

According to a further aspect of the invention, a method of making smoking articles is provided comprising the method of operating a tobacco industry rod assembly apparatus as described above.

According to yet another aspect of the invention, a method of making filter rods having a plurality of segments is provided comprising operating a tobacco industry rod assembly apparatus as described above.

In one embodiment, the method comprises picking up tobacco industry rod articles using planetary drums of the epicyclic drum arrangement and accelerating the tobacco industry rod articles up to a speed matching a rotational speed of a sun drum of the epicyclic drum arrangement.

The method may comprise rotating the planetary drums about their own axis and about an axis of a carrier supporting the planetary drums, and rotating the sun drum at a speed higher than the rotational speed of the carrier.

BRIEF DESCRIPTION OF THE DRAWINGS

Embodiments of the invention will now be described, by way of example only, with reference to the accompanying drawings in which.

DETAILED DESCRIPTION

Figure 1:
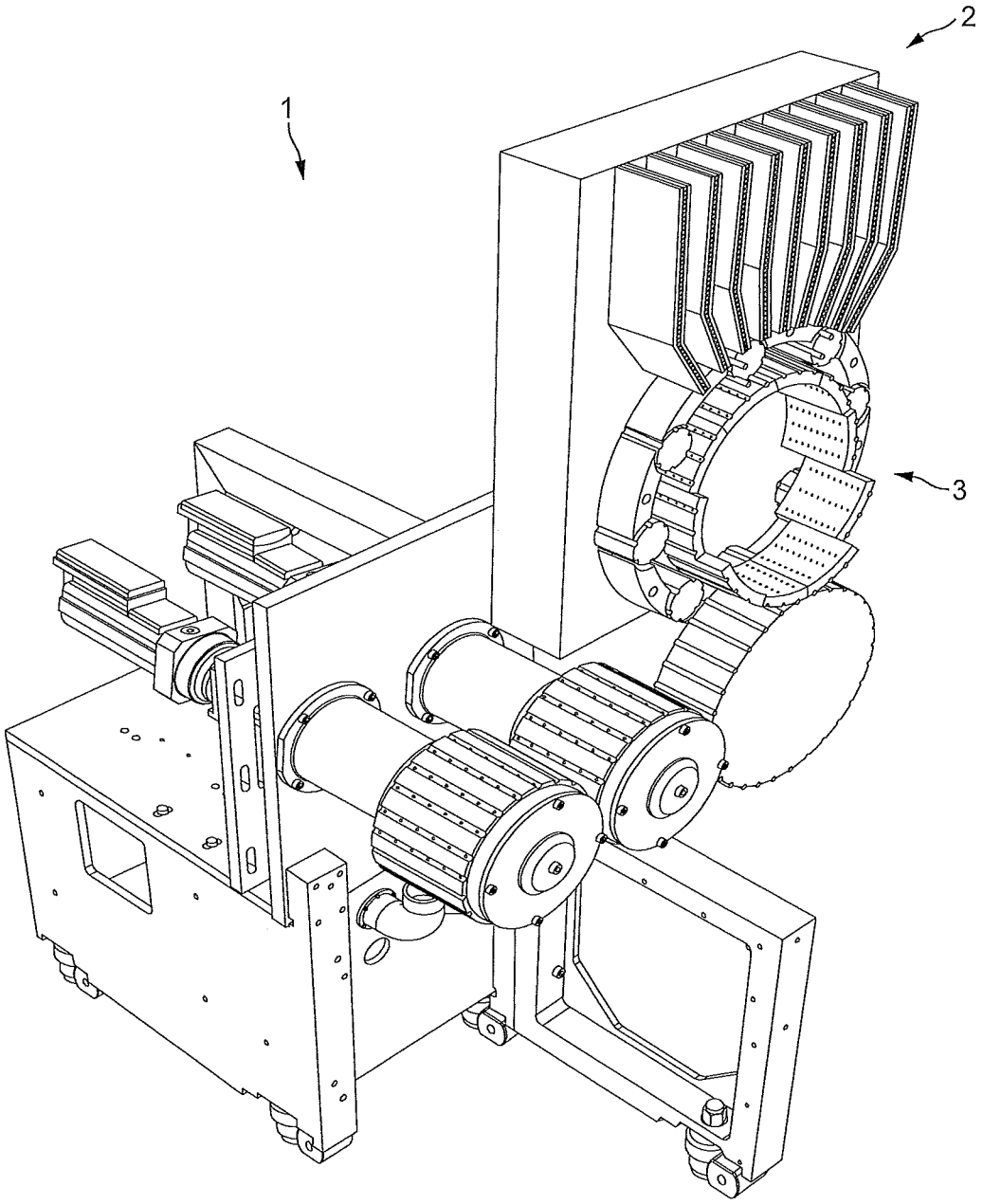
FIG. 1 shows a part of a smoking article assembly apparatus according to the present invention.

Referring now to the drawings, FIG. 1 shows a part 1 of a smoking article assembly apparatus comprising a tobacco industry rod article infeed 2 having an epicyclic drum arrangement 3. The tobacco industry rod article infeed 2 is used for transferring filter rod articles towards a subsequent assembly stage where a smoking article is assembled. Each filter rod article fed by the tobacco industry rod article infeed 2 may for example comprise a "2-up" or a "4-up" filter rod.

Those skilled in the art will be aware of various assembly stage processes and associated machinery and so the assembly stage will not be described in detail here. It will be understood that in an exemplary assembly stage, a 2-up filter rod may be positioned between two tobacco rods and the three rods may be then wrapped with a "tipping paper" so as to join them together. The centrally positioned 2-up filter rod may then be cut in two so as to form two smoking articles, each smoking article comprising a tobacco rod and a "1-up" filter rod.

In one example, the part 1 is a module of a modular smoking article assembly apparatus. Modular smoking article assembly apparatus is described in International Patent Application Publication Number WO 2012/164067.

Although the infeed 2 is described above as transferring filter rods towards an assembly stage in which a smoking article is assembled, in other embodiments the tobacco rod article infeed 2 is used to feed filter rod segments to an assembly stage which combines multiple filter rod segments and outputs a multi-segment filter rod.

Figure 2:
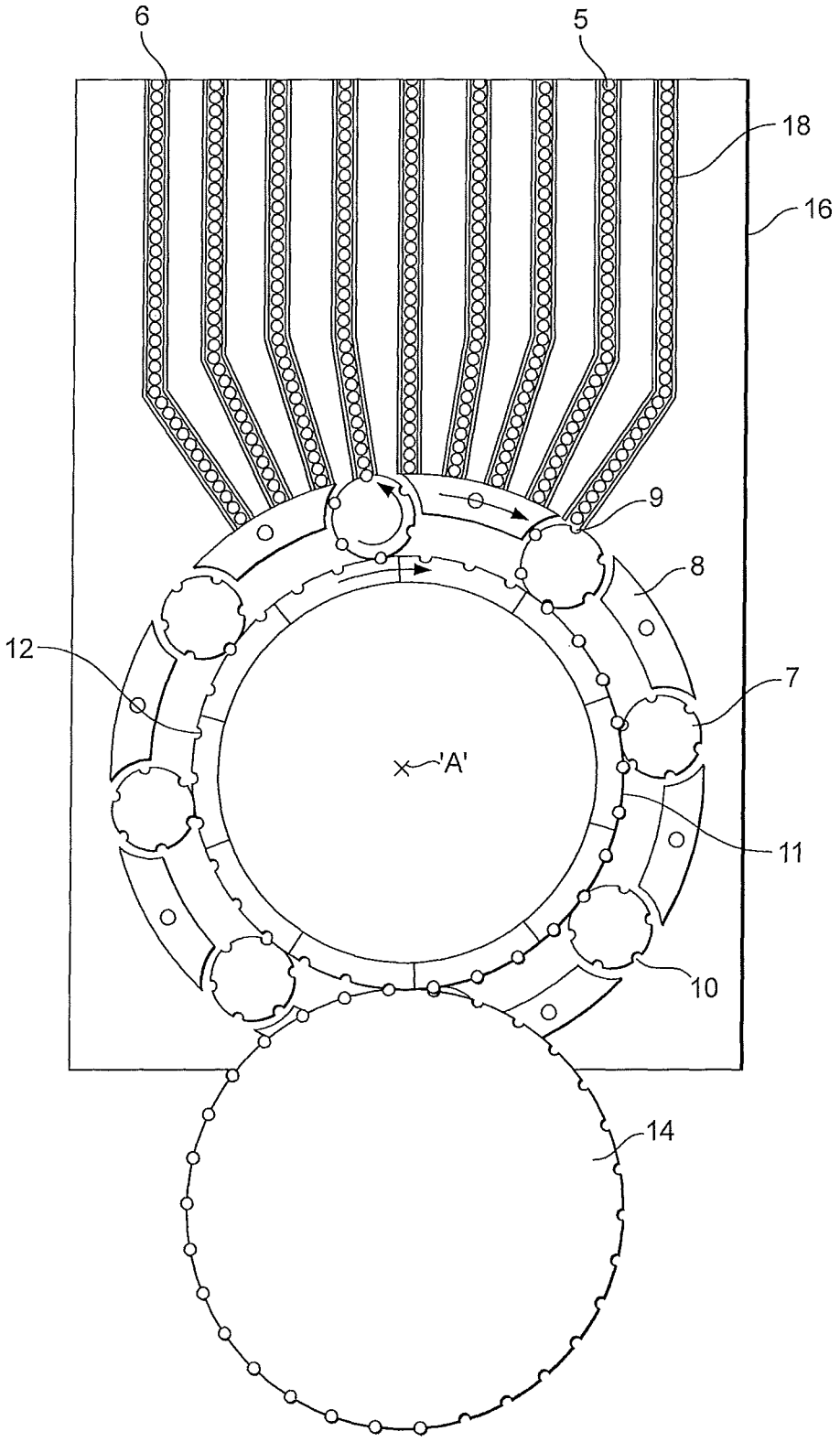
FIG. 2 shows a planar front view of a tobacco industry rod article infeed of the smoking article assembly apparatus of FIG. 1.

The tobacco industry rod article infeed 2 will now be described in more detail with reference to FIG. 2. The tobacco industry rod article infeed 2 comprises a hopper (not shown) configured to receive tobacco industry rod articles 18 from a tray feed system or a mass flow feed system, or any other appropriate means. The hopper communicates with channels 6 formed by vanes. There are nine channels 6 as can be appreciated from FIG. 2 and each channel 6 is configured to receive tobacco industry rod articles 18 from the hopper. Each channel 6 has a width such that the tobacco industry rod articles align into single columns, however this is optional. An outlet 9 of each channel 6 feeds tobacco industry rod articles 18 to the epicyclic drum arrangement 3.

The epicyclic drum arrangement 3 comprises planetary drums 7, a carrier 8 and a sun drum forming a central drum 11. In the embodiment shown in FIG. 2, there are eight planetary drums 7 supported by a rotatable annular carrier 8. Each planetary drum 7 is rotatable about their own central axis in an anti-clockwise direction, and the carrier 8 is rotated about its axis 'A' in a clockwise direction. Each planetary drum 7 has six grooves 10 and each groove 10 is configured to receive at least one tobacco industry rod article 18 from the channels 6. The tobacco industry rod articles 18 are held in the grooves 10 by suction being applied to the tobacco industry rod articles 18 through valve-operated holes (not shown) formed in the grooves 10.

The central drum 11 is disposed within the carrier 8 and is rotatable about the same common axis 'A' as the carrier 8. A circumferential outer surface of the central drum 11 is facing an inner surface of the carrier 8. The circumferential outer surface is formed with grooves 12 extending parallel to the common axis 'A'. In the particular embodiment shown in FIG. 2, the circumferential outer surface of the central drum 11 is formed with thirty grooves 12. Each groove may carry a single tobacco industry rod article 18 or a plurality of tobacco industry rod articles 18 at any given time. The tobacco industry rod articles 18 are held in the grooves 12 by suction being applied to the tobacco industry rod articles 18 through valve-operated holes (not shown) formed in the grooves 12. The thirty grooves 12 are equally spaced apart from one another in a rotational direction about the common axis, however this is optional, as in an alternative embodiment the grooves are formed into groups such that the outer surface of the central drum 11 is formed with a single or multiple group(s) of grooves.

Tobacco industry rod articles 18 are transferred from the channels 6 onto the grooves 10 of the planetary drums 7, and then onto the grooves 12 of the central drum 11. The tangential speed of the planetary drums 7 as they rotate about their own axis equals the tangential speed of the carrier 8 such that a tobacco industry rod article falls into a groove 10 of a planetary drum 7. Thus, tobacco industry rod articles are transferred from a stationary position and accelerated to a high speed by the carrier 8 and the planetary drums 7. The central drum 11 is configured to rotate at a higher angular speed than the carrier 8 and is continuously supplied with tobacco industry rod articles 18 from the planetary drums 7. It should be understood that the valves of the holes formed in the grooves 10, 12 of the planetary drums 7 and the central drum 11 are operated such that vacuum is applied at the correct rotational position so as to allow for tobacco industry rod articles 18 to be picked up, transferred and released as described above.

The central drum 11 passes on the tobacco industry rod articles 18 to a transfer drum 14 which transfers the tobacco industry rod articles to the next stage of the tobacco industry rod assembly. The next stage may include a device which combines filter segments so as to form a filter rod, or combines a filter with a tobacco rod so as to form a smoking article, or any other process of assembling a smoking article or components thereof.

It should be understood that the central drum his not limited to passing on tobacco industry rod articles to a transfer drum 14. In an alternative embodiment, the central drum 11 transfers tobacco industry rod articles to a conveyor belt or other means for transporting the tobacco industry rod articles towards an assembly stage.

The tobacco industry rod article infeed 2 may be supported by a single back plate 16 as shown in the figures, or alternatively, the components of the tobacco industry rod article infeed 2 may be supported on several back plates.

The tobacco industry rod article infeed 2 is not limited to comprising nine channels 6, eight planetary drums 7 each having six grooves 10, and a central drum having thirty grooves. It should be understood that the number of channels, planetary drums and their grooves, as well as the number of grooves on the central drum can be varied so as to fit the desired output of the tobacco industry rod assembly apparatus. For example, in one embodiment the tobacco industry rod article infeed comprises ten channels, five planetary drums, each planetary drum having ten grooves, and the central drum has twenty grooves. In another embodiment, the tobacco industry rod article infeed comprises five channels and six planetary drums.

The planetary drums 7, carrier 8 and central drum 11, are operated by a set of gears and shafts (not shown) driven by a motor (not shown). Various gearing/driving arrangements will be evident to those skilled in the art. The rotational movement of the planetary drums 7 as the planetary drums 7 are being rotated by the carrier 8 can be described as an epicyclic motion. In one embodiment, the planetary drums 7, carrier 8 and the central drum 11 are rotated in the opposite direction to that described above such that the planetary drums 7 have an epicyclic motion in the opposite direction about the common axis 'A'.

Figure 3:
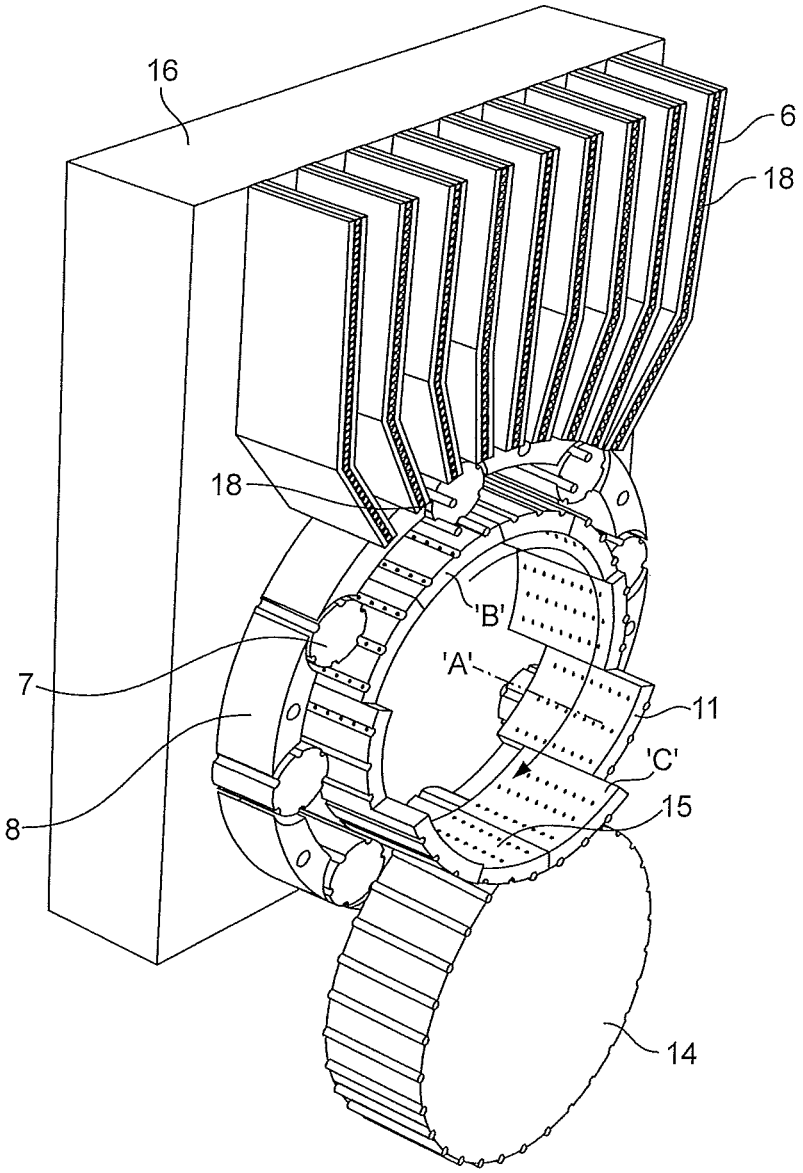
FIG. 3 shows a perspective view of the tobacco industry rod article infeed shown in FIG. 2.

Referring now to FIG. 3, the central drum 11 comprises movable segments 15 supported by a stationary barrel (not shown). The barrel is omitted from the figures so that the segments 15 can be clearly shown. An outer circumferential surface of the barrel is formed with a barrel cam which cooperates with a corresponding cam or track formed on an inner surface of the segments 15 facing the circumferential surface of the barrel. The segments are supported by two ring structures (not shown) located at the end of the segments 15 such that the segments 15 are sandwiched in between the ring structures. The ring structures are formed with pins which locate in holes of the segments. The ring structures are configured to rotate about the common axis 'A' and as their pins locate in the segments 15, the segments 15 rotate with the ring structures about said axis 'A'. The barrel cam cooperating with the cam or track on the inner surface of the segments causes the segments 15 to move relative to one another in a direction parallel to the common axis 'A' of the central drum 11 as the ring structures and the segments 15 are rotated about the barrel. As the segments 15 are rotated about the barrel, the segments 15 are moved from a pick-up position 'B' to a drop-off position 'C'. The segments 15 are in a pick-up position when they are proximal to the channels 6, and in a drop-off position when they are proximal to the transfer drum 14. The movable segments 15 of the central drum 11 enables tobacco industry rod articles to be dropped off to the transfer drum 14 without the interference of the carrier 8 and/or the planetary drums 7. In particular, the movable segments 15 enable the transfer drum 14 to overlap with the carrier 8 such that the transfer drum 14 engages the central drum 11.

Figure 4:
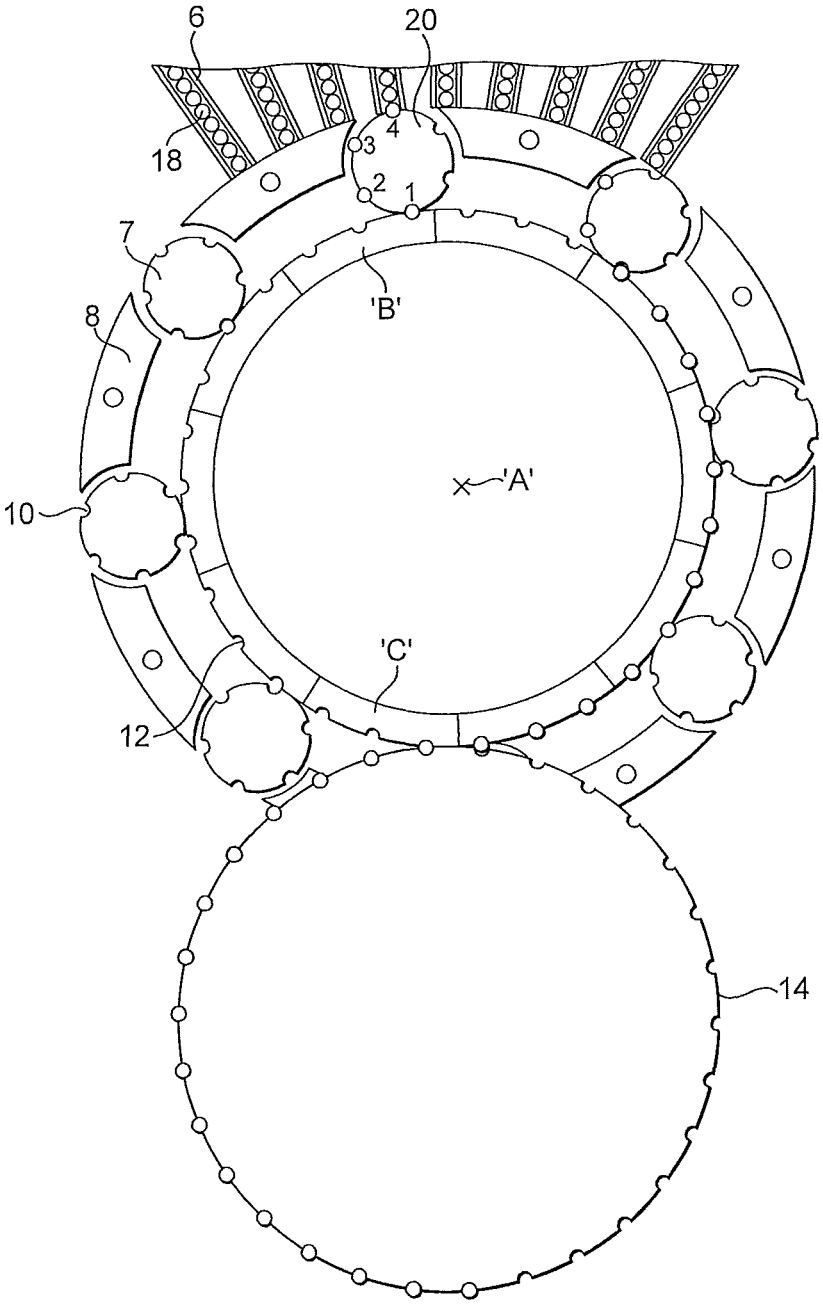
FIG. 4 shows a planar front view of the tobacco industry rod article infeed transferring tobacco industry rod articles.

Operation of the tobacco industry rod article infeed 2 will now be described in greater detail with reference to FIG. 4. The carrier 8 rotates in a clockwise direction and a first planetary drum 20 approaches the set of nine channels 6 holding columns of tobacco industry rod articles 18. As the first planetary drum 20 rotates about its own axis in an anti-clockwise direction tobacco industry rod articles 18 held in the channels 6 are transferred to the first planetary drum 20 such that a tobacco industry rod article 18 locates in each groove 10 of the first planetary drum 20. As the first planetary drum 20 rotates to pick up tobacco industry rod articles it simultaneously drops of tobacco industry rod articles that are aligned with corresponding groove 12 of the central drum 11. For example, when the first drum 20 has reached the fourth channel 6 from the left picking up a fourth tobacco industry rod article as shown in FIG. 4, it also drops off the first tobacco industry rod article to the central drum 11. As there are nine channels 6, and each planetary drum 7 has six grooves, each planetary drum transfers nine tobacco industry rod articles to the central drum 11 in one rotation. Thus, the first three grooves 10 of each planetary drum 7 transfer two tobacco industry rod articles 18 in one rotation.

It should be understood that the infeed 2 according to the present invention, is located online of a tobacco industry rod assembly apparatus, meaning that it forms part of a production line comprising a set of sequential operations for assembling smoking articles. The advantage of the epicyclic drum arrangement 3 of the tobacco industry rod article infeed 2 of the present invention is that the epicyclic motion of the planetary drums 7 allows the tobacco industry rod articles to be picked up from a stationary position at the outlet 9 of the channels 6 and accelerate them up to speed to match the rotational speed of the central drum 11. This enables the central drum 11 to rotate faster than a known standard drum which picks up tobacco industry rod articles directly from an outlet. Therefore, the overall effect of the present invention is that it enables more tobacco industry rod articles to be transferred per unit time than a standard drum. As a result, more tobacco industry rod articles can be assembled per unit time.

In order to address various issues and advance the art, the entirety of this disclosure shows by way of illustration various embodiments in which the claimed invention(s) may be practiced and provide for a superior tobacco industry rod assembly apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A tobacco industry rod assembly apparatus comprising a tobacco industry rod article infeed having an epicyclic drum arrangement, and the tobacco industry rod article infeed being configured to transfer tobacco industry rod articles towards an assembly stage, wherein the epicyclic drum arrangement comprises planetary drums on a rotational annular carrier, each planetary drum being rotatable about its own axis, and a sun drum disposed within the annular carrier, the annular carrier and the sun drum are rotatable about a common axis, wherein the sun drum comprises segments movable relative to one another in a direction parallel to the common axis.

2. A tobacco industry rod assembly apparatus according to claim 1, wherein the segments are movable relative to one another so as to enable tobacco industry rod articles to be received, transferred and released by the sun drum.

3. A tobacco industry rod assembly apparatus according to claim 1, wherein the segments are movable relative to one another so as to enable a transfer drum to overlap with the carrier such that the transfer drum engages the sun drum.

4. A tobacco industry rod assembly apparatus according to claim 1, wherein the sun drum rotates at a higher speed than the annular carrier.

5. A tobacco industry rod assembly apparatus according to claim 1, wherein the planetary drums have a tangential speed that equals a tangential speed of the sun drum.

6. A tobacco industry rod assembly apparatus according to claim 1, wherein the sun drum comprises an outer circumferential surface formed with grooves for receiving tobacco industry rod articles and the grooves are evenly spaced apart from one another in a direction about the common axis.

7. A tobacco industry rod assembly apparatus according to claim 1, further comprising a transfer drum transferring tobacco industry rod articles from the tobacco industry rod article infeed towards the assembly stage.

8. A tobacco industry rod assembly apparatus according to claim 1, wherein:

the tobacco industry rod assembly apparatus is a smoking article assembly apparatus;

said tobacco industry rod article infeed comprises a filter rod infeed to transfer filter rod articles towards the assembly stage; and the assembly stage comprises an assembly station configured to form smoking articles using said filter rod articles.

9. A tobacco industry rod assembly apparatus according to claim 8, wherein the smoking article assembly apparatus comprises a plurality of modules, and wherein one of said modules comprises the filter rod infeed.

10. A tobacco industry rod assembly apparatus according to claim 1, wherein:

the tobacco industry rod assembly apparatus is a filter rod assembling apparatus; and the assembly stage comprises an assembly station configured to combine a filter segment with another filter segment so as to form a filter rod having a plurality of segments.

11. A method of operating a tobacco industry rod assembly apparatus, comprising transferring tobacco industry rod articles towards a rod assembly stage using a tobacco industry rod article infeed having an epicyclic drum arrangement comprising planetary drums on a rotational annular carrier, and a sun drum disposed within the rotational annular carrier, the sun drum being rotatable about a common axis with the rotatable annular carrier, the method comprising picking up tobacco industry rod articles using said planetary drums, rotating the sun drum at a speed higher than the rotational speed of the rotatable annular carrier, and accelerating the tobacco industry rod articles up to a speed matching a rotational speed of the sun drum.

12. A method of making smoking articles, comprising the method of claim 11.

13. A method of making filter rods having a plurality of segments, comprising the method of claim 11.

* * * * *